US008337004B2

(12) United States Patent
Nagamine et al.

(10) Patent No.: US 8,337,004 B2
(45) Date of Patent: Dec. 25, 2012

(54) INK JET RECORDING DEVICE

(75) Inventors: Toshihide Nagamine, Toukai (JP); Akira Miyao, Hitachi (JP); Seiji Fujikura, Toukai (JP); Tadayuki Matsuda, Hitachi (JP); Hiroshi Kotabe, Hitachi (JP); Tomohiro Inoue, Tsukuba (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 104 days.

(21) Appl. No.: 12/576,916

(22) Filed: Oct. 9, 2009

(65) Prior Publication Data

US 2010/0026770 A1 Feb. 4, 2010

Related U.S. Application Data

(62) Division of application No. 12/074,171, filed on Feb. 28, 2008.

(30) Foreign Application Priority Data

Jan. 28, 2008 (JP) ..... 2008-015748

(51) Int. Cl.
*B41J 2/185* (2006.01)

(52) U.S. Cl. ..... 347/90; 347/21

(58) Field of Classification Search ..... 347/90, 347/21

See application file for complete search history.

(56) References Cited

U.S. PATENT DOCUMENTS 4,121,222 A 10/1978 Diebold et al.
4,270,133 A * 5/1981 Shimazawa et al. ..... 347/7
4,283,730 A 8/1981 Graf
4,286,274 A * 8/1981 Shell et al. ..... 347/90
4,337,468 A * 6/1982 Mizuno ..... 347/7
4,360,817 A * 11/1982 Arway et al. ..... 347/90
4,413,267 A 11/1983 Hein
4,527,170 A 7/1985 Iwasaki et al.
4,575,735 A * 3/1986 Weinberg ..... 347/7
4,602,662 A 7/1986 Eremity et al.
4,658,268 A 4/1987 Needham
4,714,931 A * 12/1987 Erskine et al. ..... 347/7
4,890,119 A 12/1989 Eremity et al.

(Continued)

FOREIGN PATENT DOCUMENTS

DE 2447919 A 10/2008

(Continued)

OTHER PUBLICATIONS

European Patent Office Search Report for application EP10007317 (Sep. 27, 2010).

(Continued)

*Primary Examiner* — Charlie Peng
*Assistant Examiner* — Peter Radkowski
(74) *Attorney, Agent, or Firm* — Kilpatrick Townsend & Stockton LLP

(57) ABSTRACT

An ink jet recording device comprises a main body equipped with an ink container, an ink supply pump ink, an ink recovery pump, and a control unit. A printing head equipped with a nozzle emits ink supplied from the main body as ink particles. An electrification electrode electrifies the ink particles and a deflection electrode deflects the electrified ink particles. A gutter collects ink particles which are not used for printing. An exhaust circulation path connects the ink container and the gutter. The gutter comprises two members of an ink flow path block in which ink flows and an exhaust flow path block in which exhaust solvent vapor flows.

4 Claims, 12 Drawing Sheets

U.S. PATENT DOCUMENTS

| | | | | | |
|---|---|---|---|---|---|
| 4,940,996 | A | * | 7/1990 | Paton et al. | 347/42 |
| 4,942,409 | A | * | 7/1990 | Paton et al. | 347/21 |
| 5,055,856 | A | * | 10/1991 | Tomii et al. | 347/30 |
| 5,155,528 | A | | 10/1992 | Morishige et al. | |
| 5,202,702 | A | | 4/1993 | Terasawa et al. | |
| 5,252,993 | A | * | 10/1993 | Tomii et al. | 347/32 |
| 5,331,339 | A | | 7/1994 | Takahashi | |
| 5,418,557 | A | | 5/1995 | Pullen | |
| 5,451,987 | A | * | 9/1995 | Perrin | 347/6 |
| 5,532,720 | A | * | 7/1996 | Krueger et al. | 347/7 |
| 5,623,292 | A | | 4/1997 | Shrivastava et al. | |
| 5,659,935 | A | | 8/1997 | Lo-Pinto et al. | |
| 5,701,149 | A | | 12/1997 | Pagnon et al. | |
| 5,758,580 | A | * | 6/1998 | Murray | 101/491 |
| 5,805,181 | A | * | 9/1998 | Tanaka et al. | 347/29 |
| 5,831,645 | A | * | 11/1998 | Shimoda | 347/30 |
| 6,234,620 | B1 | | 5/2001 | Faisst et al. | |
| 6,398,351 | B1 | | 6/2002 | Blum et al. | |
| 6,527,379 | B1 | | 3/2003 | Martin | |
| 6,575,566 | B1 | | 6/2003 | Jeanmaire et al. | |
| 6,588,339 | B2 | | 7/2003 | Naniwa et al. | |
| 6,666,548 | B1 | | 12/2003 | Sadasivan et al. | |
| 7,182,420 | B2 | | 2/2007 | Nakazawa | |
| 2001/0017103 | A1 | * | 8/2001 | Takeshita et al. | 118/50 |
| 2003/0016264 | A1 | | 1/2003 | Jeanmaire | |
| 2003/0016276 | A1 | * | 1/2003 | Jeanmaire | 347/77 |
| 2003/0202055 | A1 | | 10/2003 | Jeanmaire et al. | |
| 2004/0017421 | A1 | | 1/2004 | Jeanmaire | |
| 2004/0036735 | A1 | | 2/2004 | Garbacz et al. | |
| 2004/0066428 | A1 | | 4/2004 | West et al. | |
| 2006/0203054 | A1 | | 9/2006 | Matsuda et al. | |
| 2006/0216426 | A1 | | 9/2006 | Brown | |
| 2008/0100660 | A1 | | 5/2008 | Perrin et al. | |
| 2009/0040248 | A1 | | 2/2009 | Matsuda et al. | |
| 2009/0040283 | A1 | | 2/2009 | Matsuda et al. | |

FOREIGN PATENT DOCUMENTS

| | | | | |
|---|---|---|---|---|
| EP | 0228828 | A2 | | 7/1987 |
| EP | 0228828 | A3 | | 7/1987 |
| GB | 2098546 | A | | 11/1982 |
| GB | 2129374 | A | | 5/1984 |
| GB | 2447919 | A | | 10/2008 |
| JP | 52-037040 | A | | 3/1977 |
| JP | 56-150584 | A | | 11/1981 |
| JP | 60-011364 | A | | 1/1985 |
| JP | 63-122545 | A | | 5/1988 |
| JP | 01-247167 | A | | 10/1989 |
| JP | 10-202898 | A | | 8/1998 |
| JP | 10-324000 | A | | 12/1998 |
| JP | 2000-094657 | A | | 4/2000 |
| JP | 2004-322558 | A | | 11/2004 |
| JP | 2004322558 | A | * | 11/2004 |
| WO | WO93/17868 | A1 | | 9/1993 |
| WO | WO93/17869 | A1 | | 9/1993 |

OTHER PUBLICATIONS

European Patent Office Search Report for application EP08250679 (Sep. 27, 2010).

USPTO Office Action for U.S. Appl. No. 12/074,171 (Aug. 17, 2010).

U.S. Appl. No. 12/074,171 Office Action mailed on Feb. 28, 2011.

U.S. Appl. No. 12/576,907 Office Action mailed on Mar. 4, 2011.

U.S. Appl. No. 12/576,907 Office Action mailed on Nov. 17, 2011.

U.S. Appl. No. 12/074,171 Office Action mailed on Oct. 12, 2011.

* cited by examiner

INK JET RECORDING DEVICE

CROSS-REFERENCE TO RELATED APPLICATION(S)

This is a divisional application of U.S. patent application Ser. No. 12/074,171, filed Feb. 28, 2008, which application claims priority from Japanese Application 2008-015748 filed on Jan. 28, 2008, the entire disclosure of which is incorporated herein by reference.

BACKGROUND OF THE INVENTION

The present invention relates to an ink jet recording device for, using jetted ink particles, printing letters or characters or drawing patterns on an object to be printed, which is conveyed in a production line.

According to such an ink jet recording technology, it is possible to reduce volatilization of solvent components from the ink by supplying exhaust gas to a printing head and circulating the same. However, in an ink jet recording device, since solvents used during nozzle washing when operation of the device is stopped and the other maintenances enter an ink circulation path, ink concentration will be reduced.

For this reason, when discharging of the exhaust gas outside the device is continued, solvent components volatilized from ink will also be discharged outside the device, and therefore, the ink concentration will gradually return to around the original concentration thereof.

On the other hand, if the technology of circulating the exhaust gas is continuously used, volatilized amount of solvent components from the ink becomes small since circulating exhaust gas is saturated with solvent vapor, so that there is a problem that control of the ink concentration within a desired concentration range will be difficult, disabling a stable and good printing result to be obtained.

Moreover, in the above-mentioned ink jet recording device, positions and manners to connect a pipe which guides solvent vapor exhausted from an ink container to a gutter with the gutter are not considered. Moreover, the flow path shape of the gutter and the shape of ink collision plane are also not considered.

For this reason, although the gutter has a function to receive ink particles not used for printing, and by sucking them using negative pressure to recover them into an ink container, there has been a problem that, at some connection positions between the ink flow path of the gutter and the solvent vapor exhausted from the ink container, the suction force for the ink may reduce, and the ink once entered the gutter may backflow and overflow, resulting in pollution of environment of the device.

Moreover, there has also been a problem that if the ink collides vertically to an ink collision plane in the gutter, scattered ink droplets occur during collision, and in some cases, they may fly out from the gutter and collide with ink particles for printing, resulting in disturbance of printing.

Further, there has also been a problem that if the connection between a path connected to the ink container and the gutter is imperfect, the solvent vapor is flown out from the imperfection part, and air is taken in from external air.

Moreover, a device in which a single device has two jet nozzles is known. However, a technology to provide a flow path for supplying gas taken in during recovering ink into the gutter with the device having two jet nozzles has not been proposed.

Therefore, in an ink jet recording device which has two or more nozzles, the volatilized matters of the solvent components contained in ink have been discharged outside the device.

When a single device has two nozzles for continuously spouting ink, two gutters for collecting ink not used for recording are also needed. Although, it is also possible to, while matching the two jet directions with the collection port of one gutter, collect ink simultaneously by one gutter, in order to detect the minute amount of electrifications for checking the electrification timing of ink particles after they are collected by the gutter, it is desirable to have two gutters.

During recovering the ink after collected in the ink container, since both of the two gutters have taken gas in, the solvent components of the ink is volatilized in the gas during recovering, and the gas returns to the ink container while containing the solvent vapor. Although, a prior art technology where the solvent vapor is supplied from the ink container via a solvent vapor supply flow path to the gutters, is known, if the solvent vapor is supplied to only anyone of the two gutters, for example a gutter A, a gutter B to which the solvent vapor is not supplied, will newly take external air in.

This leads to collapse of the balance between the recovery amount and the supply amount of the gas, thereby, disables the gutter A to circulate at 100%, causing a part of the solvent vapor supplied to the gutter A to be discharged outside the device from the collection port of gutter A. Moreover, if the gas circulates only through the gutter A, there is possibility that the gutter B to which the gas is not supplied cannot take in gas, and due to poor suction force for ink, the ink collected by the gutter B overflows from the collection port of the gutter.

BRIEF SUMMARY OF THE INVENTION

In order to solve the above mentioned problems, according to one aspect of the present invention, there is provided an ink jet recording device, comprising: a main body equipped with an ink container which accumulates ink, an ink supply pump which supplies the ink, an ink recovery pump which recovers the ink, and a controller; a printing head equipped with a nozzle which jets the ink supplied from the main body as ink particles, an electrification electrode which electrifies the ink particles, a deflection electrode which deflects the electrified ink particles, and a gutter which collects ink particles which are not used for printing; and a cable in which an ink supply flow path which supplies the ink from the main body to the printing head, an ink recovery flow path which returns the ink particles collected by the gutter into the ink container, an exhaust gas circulation path which connects the ink container with the gutter, and various signal lines which connect the controller and the printing head, are arranged, wherein the gutter is composed of two members of an ink flow path block in which ink flows, and exhaust flow path block in which exhaust solvent vapor flows.

Moreover, according to another aspect of the present invention, there is provided an ink jet recording device comprising: unit which supplies ink under pressure from an ink container to a nozzle of a printing head; a gutter which recovers ink which is not used for printing; unit which sucks and recovers the ink recovered by the gutter into the ink container; and unit which supplies exhaust gas containing solvent vapor component in the ink recovered together with the ink inside the printing head, wherein there is provided unit which is branched from a path for supplying the exhaust gas into the printing head and which discharges the exhaust gas outside the device.

Moreover, according to other aspect of the present invention, there is provided an ink jet recording device which performs recording by supplying ink from an ink container in which ink is accumulated, to continuously jet the ink from a nozzle, by generating ink particles continuously while vibrating the ink, and by electrifying and deflecting any of the ink particles to reach them to predetermined positions on a recording medium, and which comprises gutters which collect the ink particles not used for recording, a recovery flow path for recovering the ink collected by the gutters into the ink container, a solvent vapor supply flow path for supplying gas containing solvent vapor recovered in the ink container together with the ink, and two or more nozzles, wherein the solvent vapor supply flow path is communicated with two or more gutters.

According to the present invention, an amount of solvent discharged from the ink jet recording device can be reduced by arbitrarily controlling the circulation of exhaust gas and the discharging of the exhaust gas outside the device, and printing with stable quality can be obtained.

Moreover, according to the present invention, a stably operable ink jet recording device can be provided in which the ink once entered the gutters is prevented from back-flowing by connecting an exhaust path block between an ink inflow port of an ink flow path block and an ink collision plane, splashes during collision of the ink particles are eliminated by causing the exhaust flow path block to be a circular pipe, and the solvent vapor is prevented from flown out and air intake from external air is prevented by employing such a structure in which the concave part and the convex part of a connection portion of the ink flow path block and the exhaust flow path block closely fit with each other, or perfectly blocking the connection portion.

Moreover, according to the present invention, solvent vapor returned to the ink container at the same time when the ink is recovered from the gutters, can be efficiently circulated inside the ink jet recording device, thereby, it is not necessary to discharge the solvent matter content outside the device. Moreover, an ink jet recording device which has two or more jet nozzles and which can recover collected ink to the ink container without overflowing.

BRIEF DESCRIPTION OF THE DRAWINGS

These and other features, objects and advantages of the present invention will become more apparent from the following description when taken in conjunction with the accompanying drawings, wherein.

DETAILED DESCRIPTION OF THE PREFERRED EMBODIMENTS

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications a fall within the ambit of the appended claims.

First Embodiment

Hereinafter, a first embodiment will be described.

Figure 3:
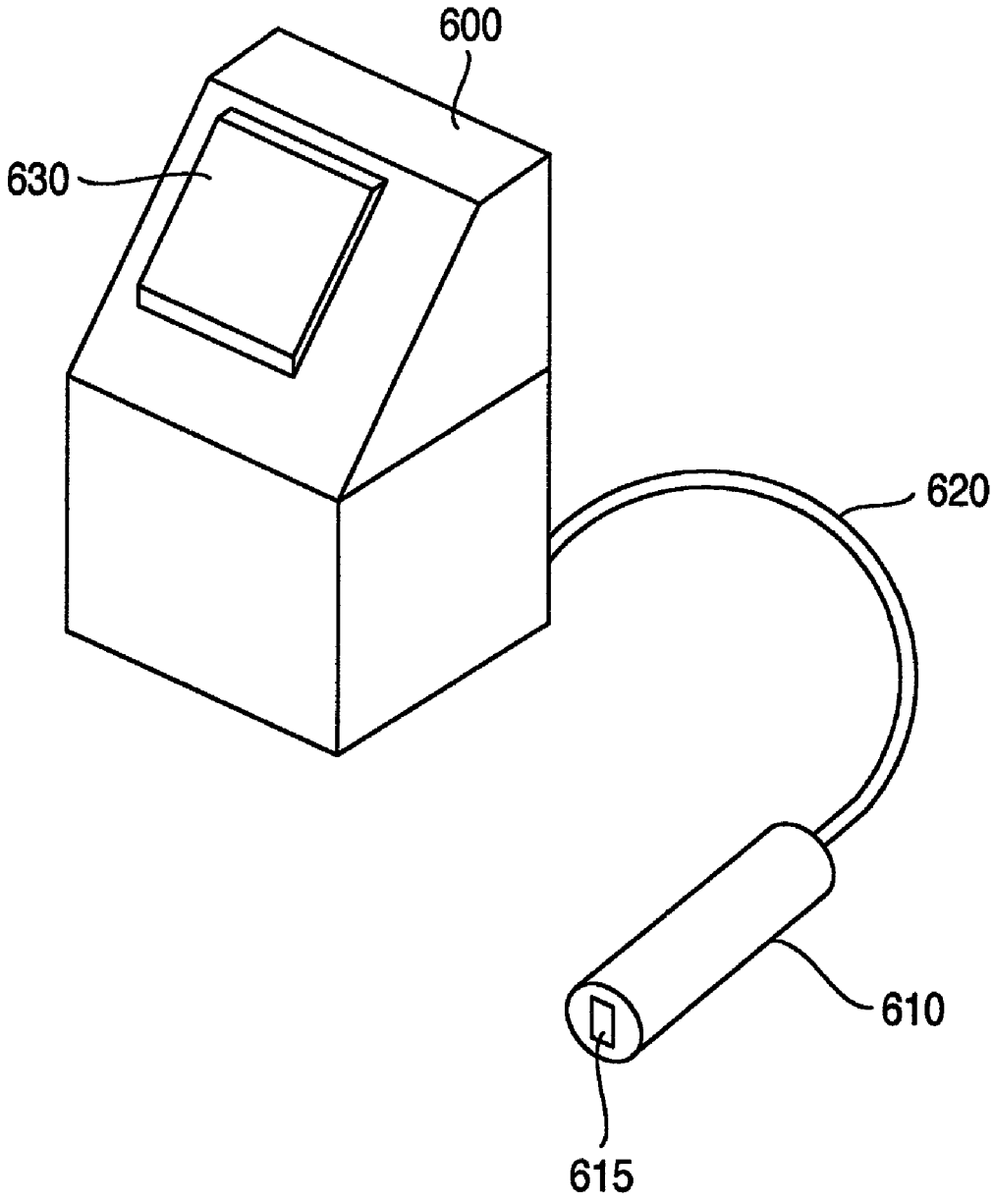
FIG. 3 is a schematic view illustrating the configuration of the ink jet recording device according to the present invention.

FIG. 3 is shows the configuration of an ink jet recording device according to a first embodiment of the present invention. The ink jet recording device comprises a main body 600 which contains a control system and a circulation system, a printing head 610 having a nozzle which jets ink to generate ink particles, and a cable 620 connecting the main body 600 and a circulation system and a control system in the printing head 610.

The main body 600 is equipped with a liquid crystal panel 630 enabling a user to input print content, print specification and the like, and content of control, an operation state of the device, and the like to be displayed, and an operation control part of the control system.

The printing head 610 is covered with a cover made of stainless steel, in which a printing part to generate ink particles and to control flight of the ink particles is contained. A hole 615 provided in the bottom surface of the cover has a function through which the ink particles pass.

Figure 4:
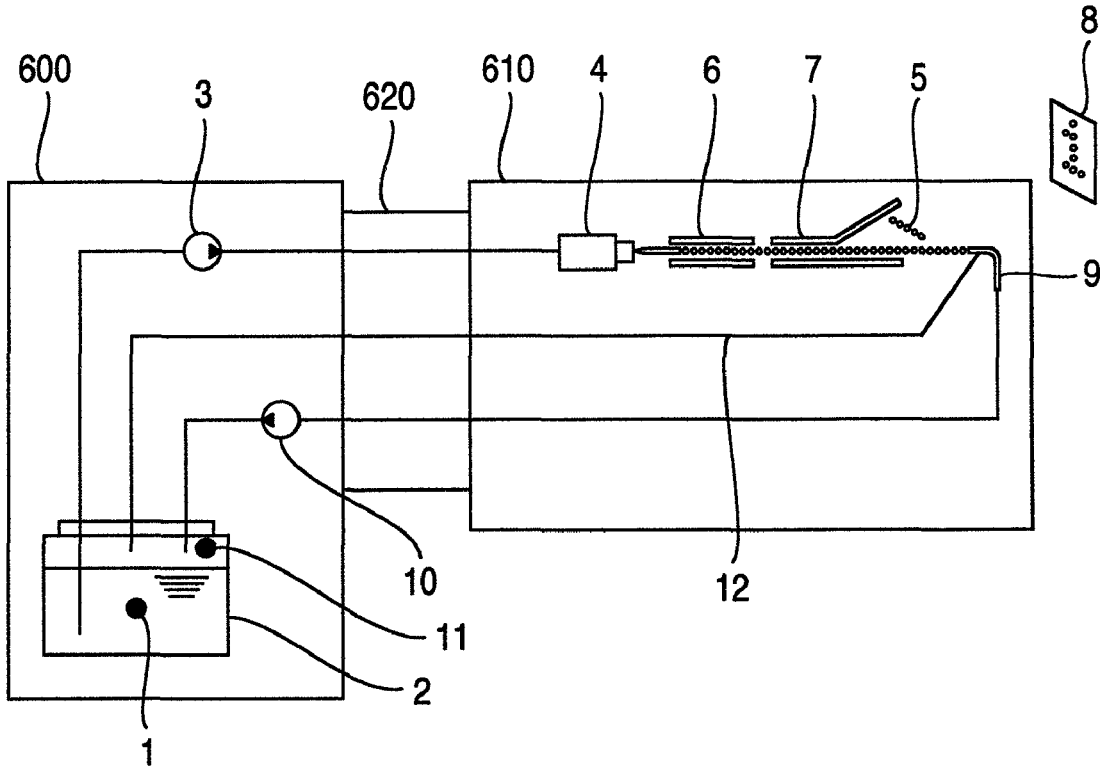
FIG. 4 is a schematic view illustrating the ink circulation path of the ink jet recording device according to a first embodiment.

FIG. 4 shows ink circulation path of the ink jet recording device according to the first embodiment of the present invention.

In the main body 600, as a path for supplying ink 1 to a nozzle 4, an ink supply pump 3, and as a path for recovering ink particles 5 collected from a gutter 9 into an ink container 2, an ink recovery pump 10, are included.

The path having the ink supply pump 3 is connected to the nozzle 4 of the printing head 610 through the cable 620.

In the ink container 2, there is an exhaust circulation path 12, which is connected to the gutter 9 of the printing head 610 through the cable 620, other than the path for supplying the ink 1 and the path for collecting the ink particles 5.

The ink 1 is sent to the nozzle 4 by the ink supply pump 3, is made into the ink particles 5, and is jetted.

The ink particles 5 used for printing are electrified inside an electrification electrode 6, are deflected by a deflection electrode 7 depending on amounts of electrifications of the ink particles 5, and reach a printing object 8.

Since ink particles 5 not used for printing are not electrified inside the electrification electrode 6, they are not deflected in the deflection electrode 7 and fly to the gutter 9 to be collected there.

The exhaust circulation path 12 connected from the ink container 2 to the gutter 9 discharges solvent vapor 11 filling inside the ink container 2 to the gutter 9.

The gutter 9 recovers the ink particles 5, and simultaneously recovers the solvent vapor 11.

Therefore, the ink recovery pump 10 returns the ink particles 5 and the solvent vapor 11 to the ink container 2.

Since being sent from the ink container 2 through the exhaust circulation path 12 to the gutter 9 and returned to the ink container 2 by the ink recovery pump 10, the solvent vapor 11 is always circulating.

Figure 1:
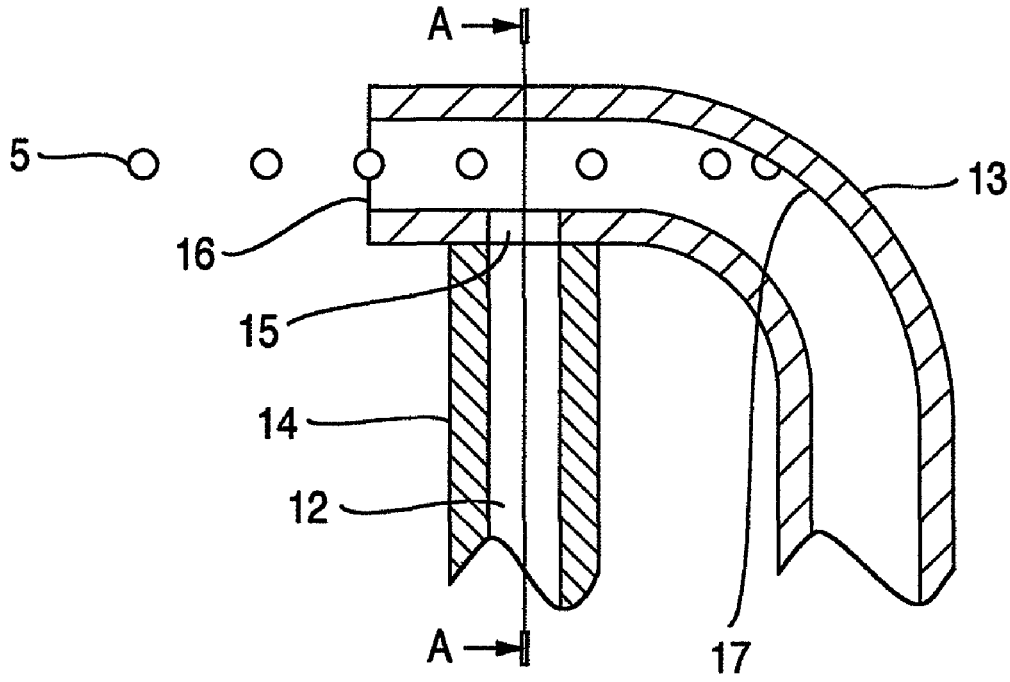
FIG. 1 is a cross-sectional view of a gutter portion according to a first embodiment.

FIG. 1 shows a schematic view of a gutter according to the first embodiment of the present invention.

The gutter 9 comprises two components of an ink flow path block 13 and an exhaust flow path block 14.

The shape of the ink flow path block 13 is a circular pipe, and the ink particles 5 which are jetted from the nozzle 4 and not used for printing, fly to an ink inflow port 16 of the ink flow path block 13 and collide with an ink collision plane 17.

The position of an exhaust connection port 15 of the ink flow path block 13 is provided between the ink inflow port 16 and the ink collision plane 17.

Since the ink flow path block 13 has a shape of a circular pipe and is a bent product, and the part of the ink collision plane 17 is a curved plane, during collision of the ink particles 5, splashes do not occur.

By causing the configuration of the gutter 9 to be composed of two components of the ink flow path block 13 and the exhaustion flow path block 14, setting the position of the exhaust connection port 15 to be between the ink inflow port 16 and the ink collision plane 17, and connecting the exhaust flow path block 14 to the ink flow path block 13, ink once entered the ink flow path block 13 will not back-flow.

Figure 2:
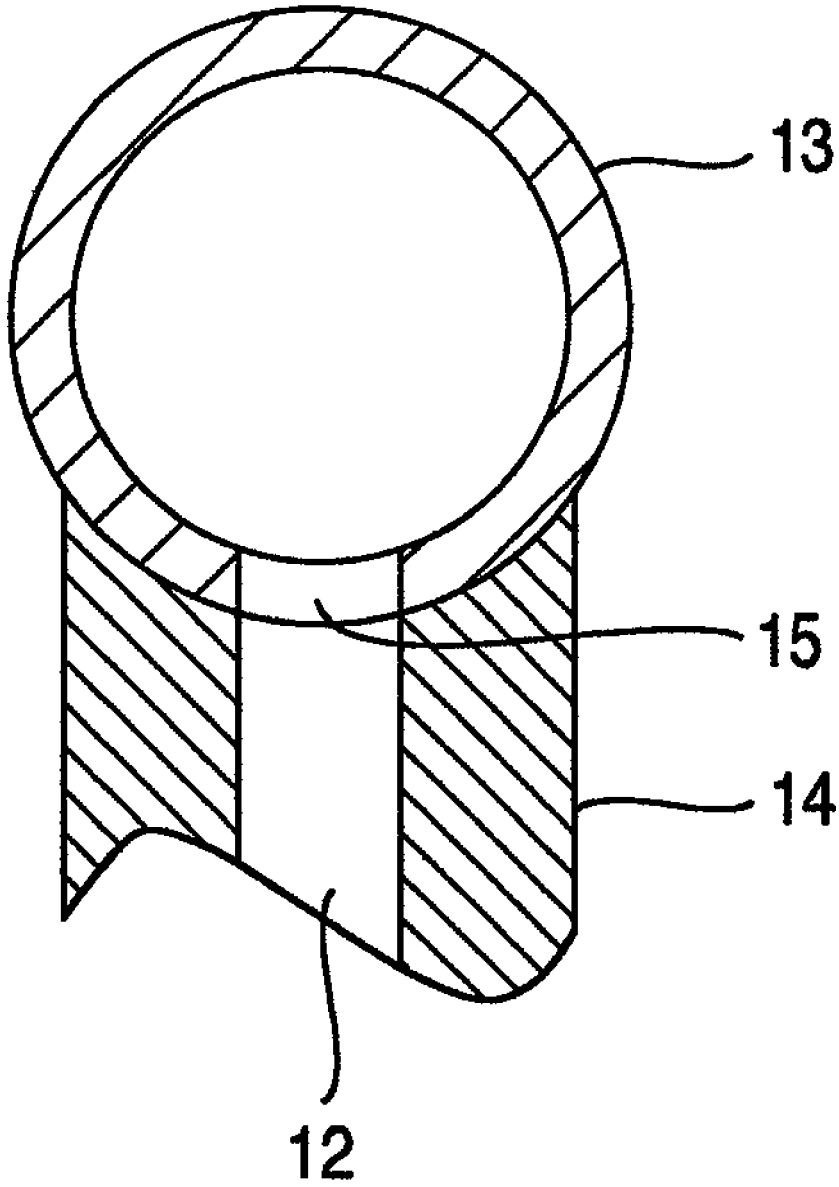
FIG. 2 is a cross-sectional view taken along line II-II in FIG. 1.

FIG. 2 is a cross-sectional view, taken along line II-II in FIG. 1, of the gutter.

By causing the connection portion between the ink flow path block 14 and the exhaust flow path block 15 to have a shape so that a concave part and a convex part closely fit with each other, flowing out of the solvent vapor 11 and taking air in from external air from the connection portion are prevented.

Figure 5:
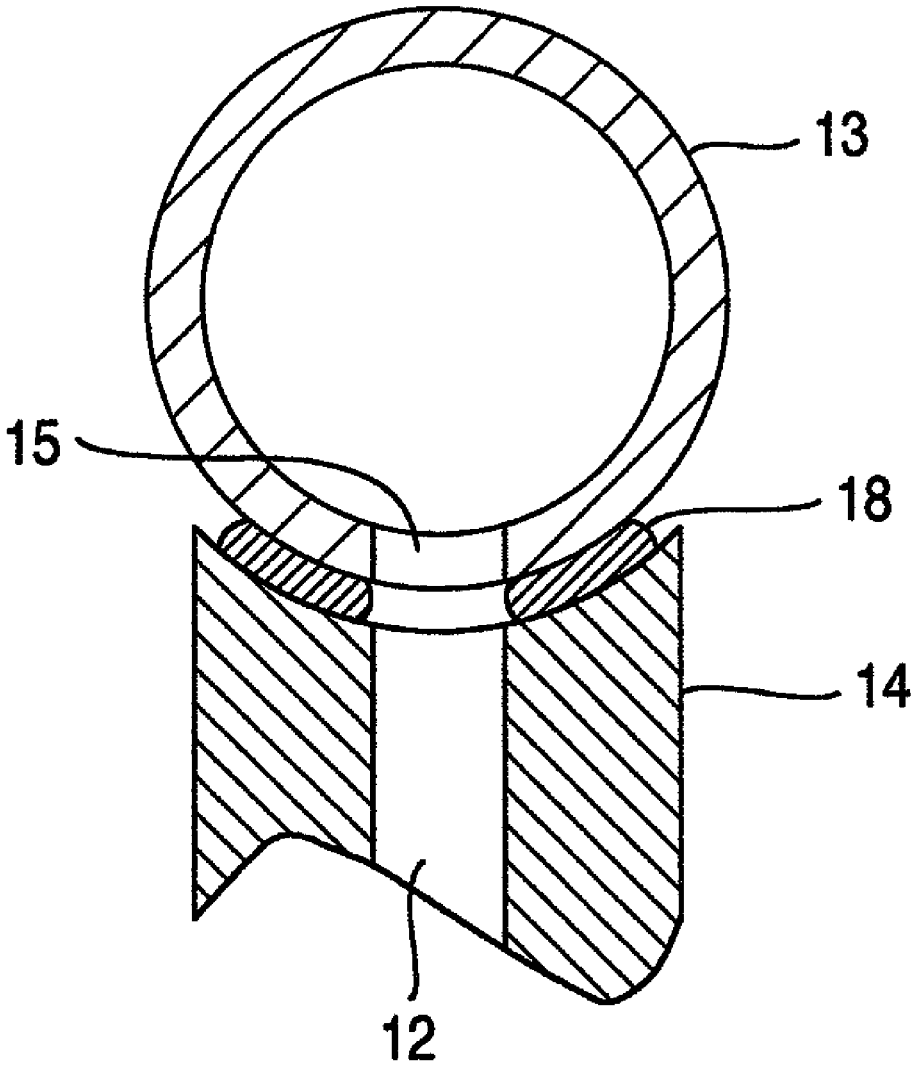
FIG. 5 is a cross-sectional view, similar to FIG. 2, of another gutter portion.

Another structure by which the similar effect can be obtained is shown in FIG. 5.

An elastic body 18 is intervened between the ink flow path block 14 and the exhaust flow path block 15. The shape of the elastic body 18 is a shape of doughnut having a space at its center portion.

Since the elastic body 18 is intervened between the ink flow path block 13 and the exhaust flow path block 14 to be compressed, the exhaust connection port 15 and the exhaust circulation path 12 are connected, thus, resulting in solution of the above mentioned problem.

Figure 6:
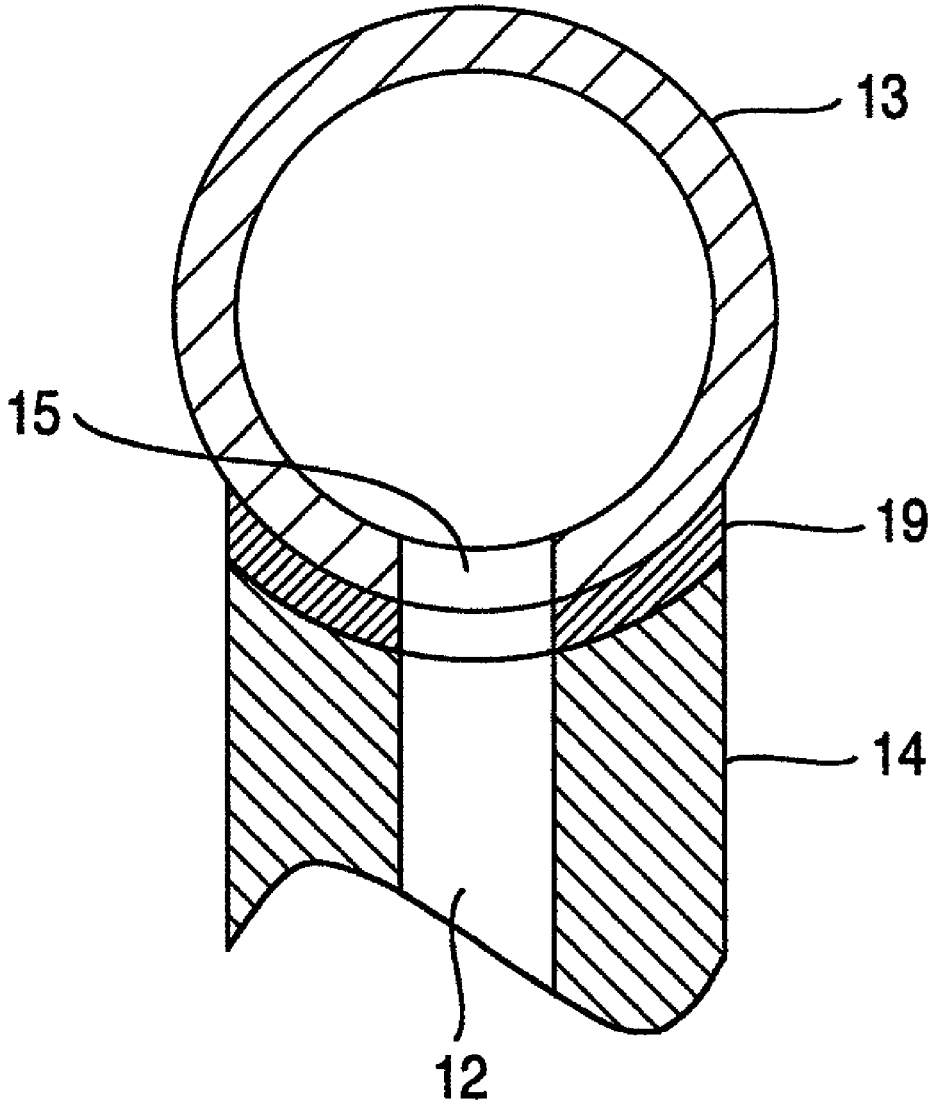
FIG. 6 is a cross-sectional view, similar to FIG. 2, of other gutter portion.

Other structure by which the similar effect can be obtained is shown in FIG. 6.

By causing the exhaust connection port 15 of the ink flow path block 13 and the exhaust circulation path 12 of the exhaust flow path block 14 to get close, and then by subjecting the connection portion to adhesion or welding 19, the above-mentioned problem is solved. In this manner, an ink jet recording device enabling stable operation can be provided.

Second Embodiment

Hereinafter, a second embodiment will be described with reference to drawings. Note that descriptions with regard to parts which are common to the above-mentioned first embodiment will be eliminated.

Figure 7:
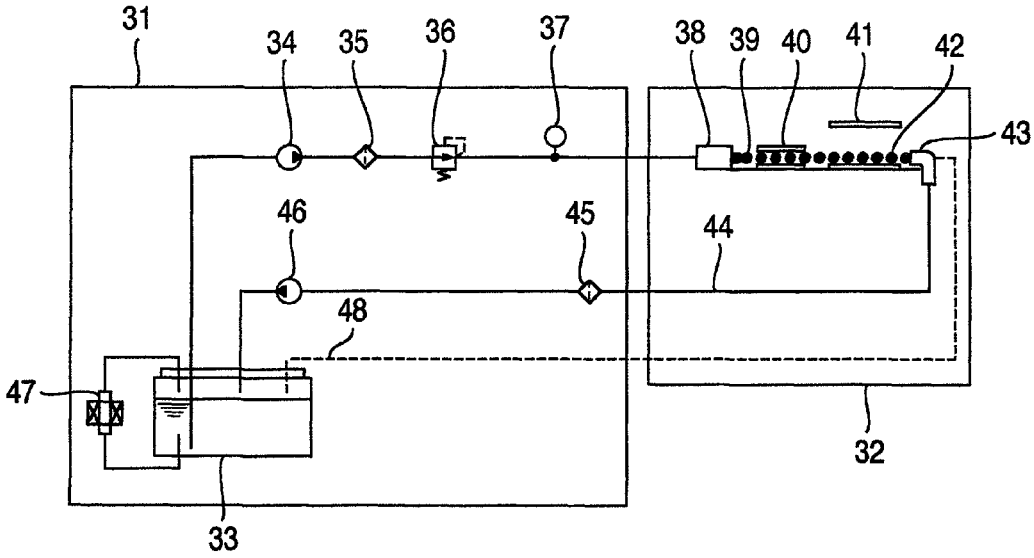
FIG.7 PRIOR ART
FIG. 7 is a configuration view of the paths of the ink jet recording device according to a prior art.

FIG. 7 is a view illustrating a prior art technology mode in which exhaust gas is supplied to a printing head 32. The ink jet recording device is separated into a main body 31 and a printing head 32, and between them are connected by a cable for protecting a piping tube and an electric wire. The ink in the ink container 33 in the main body 31 is sucked by the supply pump 34, and then fed to a secondary side.

Foreign mattes in the pumped ink are removed by a filter 35, and then adjusted to a predetermined pressure by a pressure regulator 36. Wile the adjusted pressure being monitored by a pressure gauge 37, the ink is sent to the printing head 32. The ink is made ink particles 39 by jetted from a nozzle 38, and electrified by an electrification electrode 40 according to need and deflected by a deflection electrode part 41 to which a high voltage is applied, then used for printing. Ink particles 42 not used for printing is caught by a gutter 43, passed through a recovery path 44, removed foreign matters by a recovery filter 45, sucked by a recovery pump 46, and then returned to the ink container 33. During operation, the concentration of the ink held inside the ink container 33 is measured by a densitometer 47, periodically.

Although air sucked from the gutter 43 together with the recovered ink contains gas that is the vapor of solvent in the ink and usually discharged outside the device, in the mode shown in FIG. 7, it is sent to the gutter 43 through an exhaust circulation path 48. Therefore, the exhaust gas containing the volatilized solvent component circulates through the recovery path 44 and the exhaust circulation path 48, and it is not discharged outside the device.

In the mode shown in FIG. 7, since exhaust gas is not discharged outside the device, an amount of the solvent component volatilized from the ink circulating inside the path will become small. Therefore, even if, the ink inside the path is filled with solvent by any factor, and the densitometer 47 detects the reduction of the ink concentration inside the path, it takes time for the ink concentration to return by the volatilization of the solvent, and this will be a problem.

Figure 8:
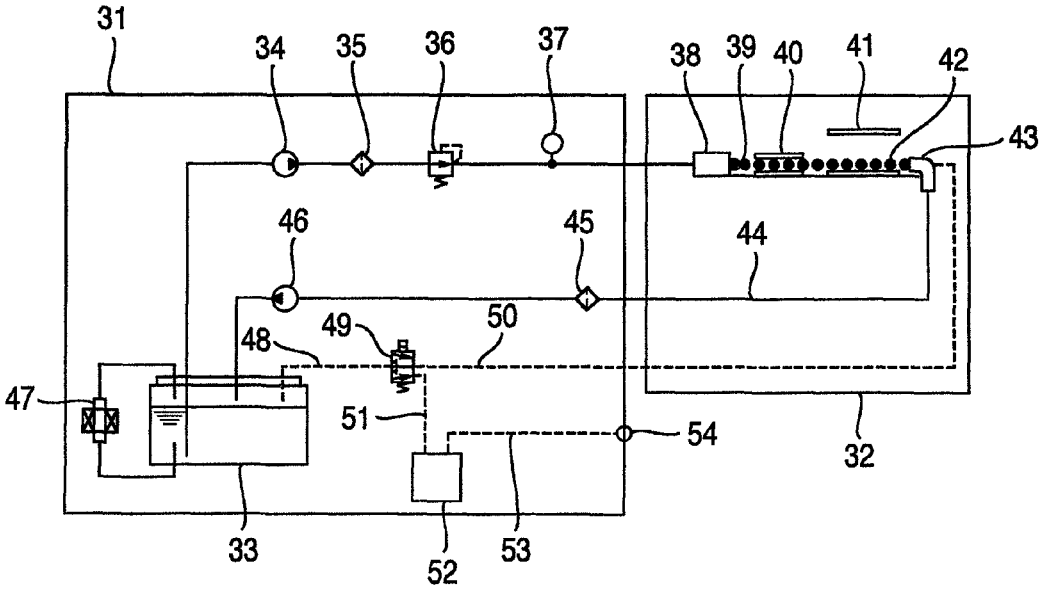
FIG. 8 is a configuration view of the paths of the ink jet recording device according to a second embodiment.

In the structure shown in FIG. 8, a 3-port electromagnetic valve 49 is arranged on the exhaust circulation path 48. An inlet thereof is one port for the exhaust circulation path 48, an outlet thereof has two ports respectively connected to the exhaust circulation path 50 and a discharge outside device path 51, and ON/OFF of the 3-port electromagnetic valve 49 causes only one of the outlet ports to be in an open state. In the present embodiment, the exhaust circulation path 50 is connected to a port so as to be in a normal open state, and the discharge outside device path 51 is connected to a port so as to be in a normal closed state.

Therefore, when the 3-port electromagnetic valve 49 is in OFF (voltage is not applied) state, the exhaust gas is sent to the gutter 43 through the exhaust circulation path 50, and together with the collected ink sent into the ink container 33 through the recovery path 44. When the 3-port electromagnetic valve 49 is in ON (voltage is applied) state (operation state), the exhaust circulation path 50 becomes in a closed state, and the exhaust gas is sent into a solvent recovery device 52 through the discharge outside device path 51. A Peltier module is incorporated in the solvent recovery device 52, and by cooling the exhaust gas, the solvent component in the exhaust gas is liquefied and recovered. With regard to a specified example of the solvent recovery device, refer to JP-A-2004-322558. The exhaust gas in which the solvent component is separated is discharged outside the device from an exhaust port 54 through an exhaust path 53.

Figure 12:
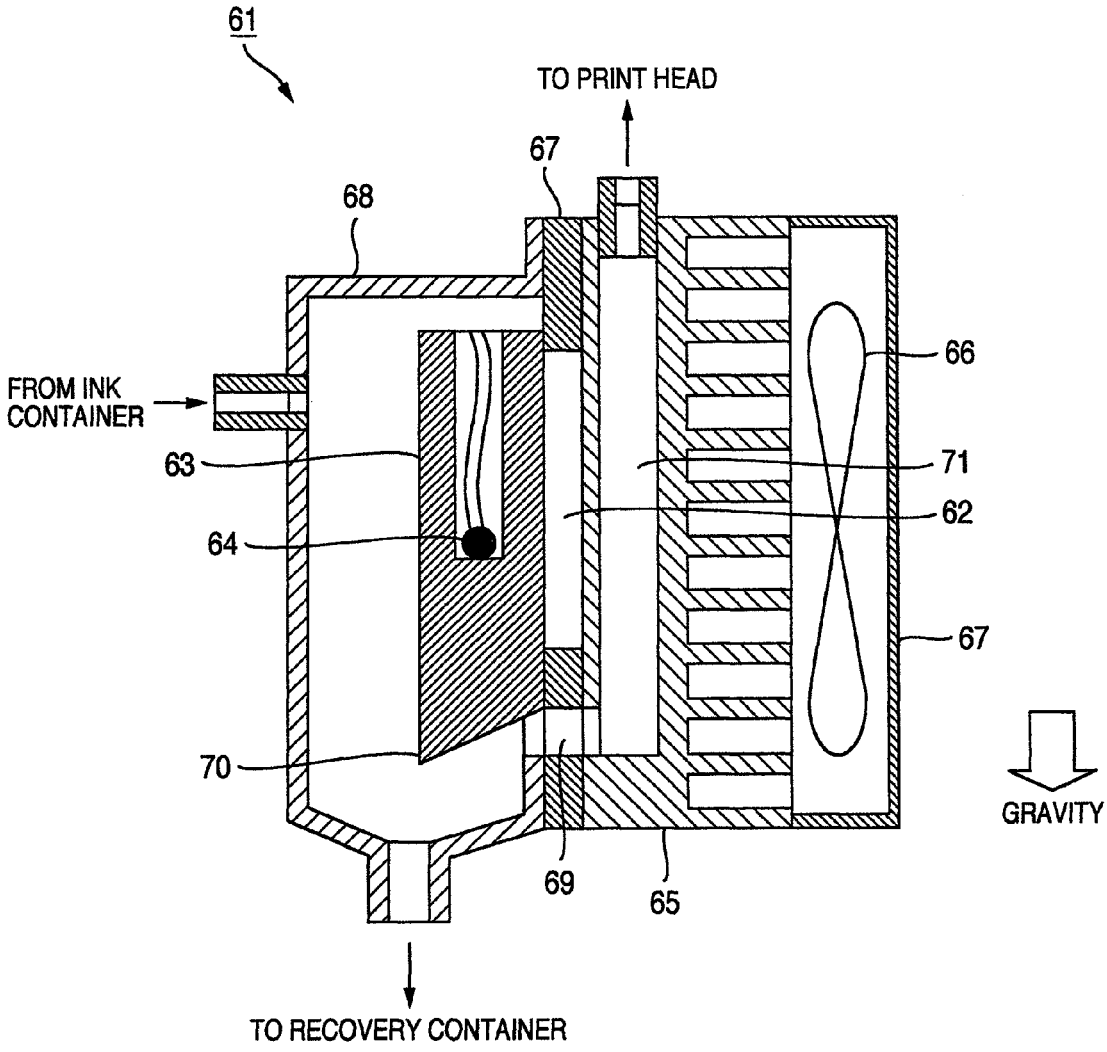
FIG. 12 is a cross-sectional view of an example of the solvent liquefying device.

The exhaust gas sent to the solvent recovery device 52 is sent to a solvent liquefier included inside the solvent recovery device. As for the solvent liquefier, one example thereof will be described with reference to FIG. 12.

In the solvent liquefier 61, the exhaust gas is cooled, volatilized solvent is liquefied, and the liquefied solvent is guided to a recovery container (not shown). Moreover, after being warmed in the solvent liquefier 61, the exhaust gas is adapted to be guided to the printing head 610.

At a low temperature (heat absorption) side of the Peltier module 62, a cooling plate 63 is attached. The cooling plate 63 is made of SUS 304, in which a thermocouple 64 is included, which controls the temperature of the cooling plate 63 by the input current of the Peltier module 62.

The cooling capacity of the Peltier module used in the present embodiment is 10 W. Moreover, at a high temperature (heat radiation) side of the Peltier module 62, heat radiating fins 65 are attached. A cooling fan 66 is attached to the heat radiating fins 65, and, while blowing ambient air on the heat radiating fins 65, cools the heat radiating fins 65. Between the heat radiating fins 65 and the cooling plate 63, a heat insulation sheet 67 is placed so as to surround the Peltier-module 62, and thermally insulates between the heat radiating fins 65 and the cooling plate 63.

A case 68 covers the cooling plate 63, and a path to the ink container, a path to the nozzle head, and a passage 69 to the heat radiating fins 65 are connected. The exhaust gas from the ink container is guided into the case 68 from the discharge outside device path 51.

The exhaust gas is cooled by the cooling plate 63 and then liquefied. The liquefied liquid adheres to the surface of the cooling plate 63 in membrane. And soon it gathers to a tip portion 70 at a lower side of the cooling plate 63 due to the weight thereof, becomes to droplets and falls, and is returned to a solvent recovery container through a recovery tube. The exhaust gas after contacted to the cooling plate 63 passes through a flow path 71 provided to the heat radiating fins 65 from the passage 69. At that time, the cooled exhaust gas is warmed to near ambient temperature by the flow path 71.

Since, after that, the exhaust gas is supplied to the printing head 610, the temperature inside the printing head 610 is not reduced by the exhaust gas, thereby, dew condensation does not occur. Further, since the exhaust gas supplied inside the printing head is recovered into the ink container together with ink by the gutter, an amount of solvent released outside the ink jet recording device can be reduced.

Figure 9:
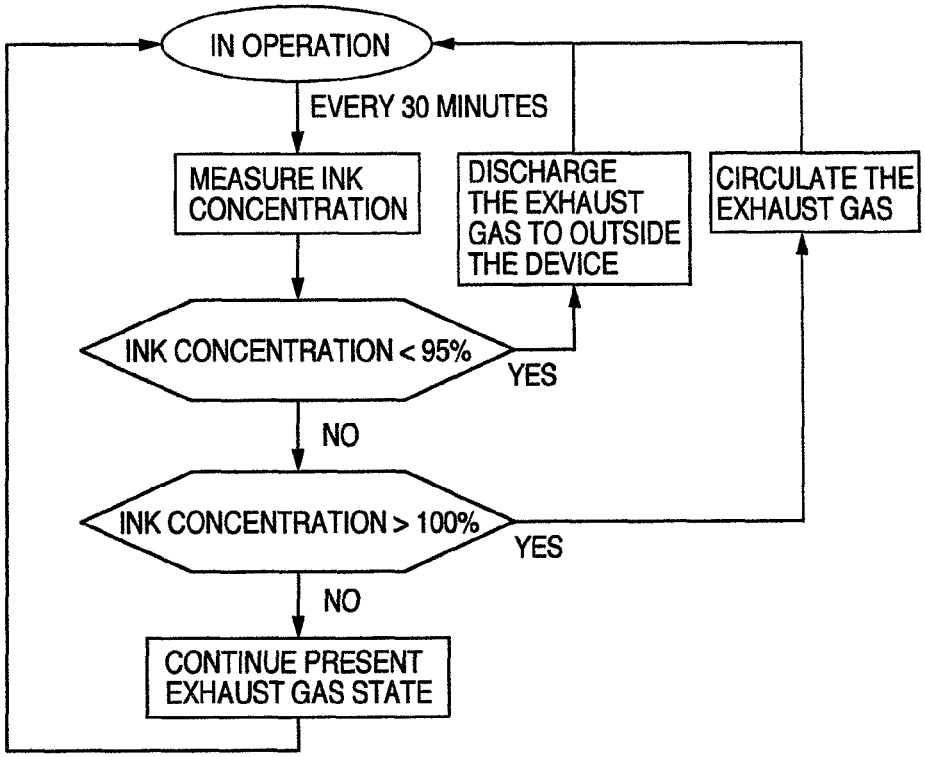
FIG. 9 is an operational flow chart of the ink jet recording device according to the second embodiment.

FIG. 9 shows an operational flow of the exhaust gas in the present embodiment. During operation of the ink jet recording device, here, measurement of the ink concentration is performed at intervals of 30 minutes. When the measurement result of the ink concentration becomes less than 95% (when standard value is set as 100%), the 3-port electromagnetic valve 49 is caused to be in ON state so that the exhaust gas is discharged outside the device. The operation is continued until the ink concentration becomes more than 100%. When the ink concentration becomes more than 100%, the 3-port electromagnetic valve 49 is caused to be in OFF state, and the exhaust gas is sent toward the gutter 43 of the printing head 32, thus exhaustion and circulation of the exhaust gas are performed. The operation is continued unless the ink concentration becomes less than 95%.

Third Embodiment

Hereinafter, a third embodiment will be described with reference to drawings. Note that descriptions with regard to parts which are common to those in the above mentioned embodiments are eliminated.

Figure 10:
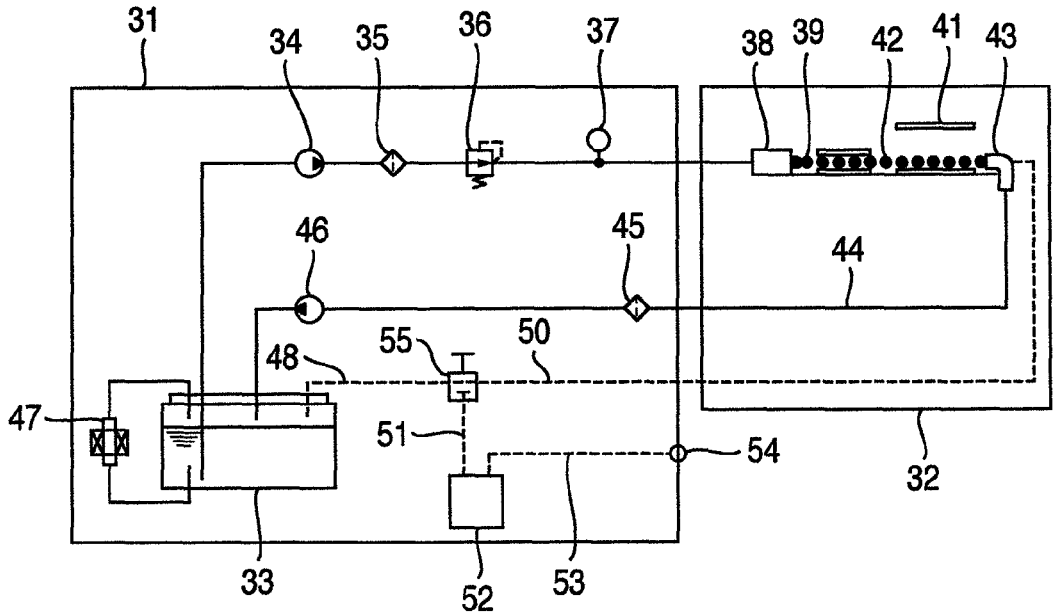
FIG. 10 is configuration view of the paths of the ink jet recording device according to a third embodiment.

The configuration of the third embodiment illustrated in FIG. 10 uses a manual type valve 55 instead of the 3-port electromagnetic valve 49 in the second embodiment. In operation of the manual type valve 55, by causing the exhaustion path 48 and the exhaust circulation path 50 to be in open state, the discharge outside device path 51 can be closed, and on the other hand, by causing the exhaustion path 48 and the exhaust circulation path 50 to be in closed state, the discharge outside device path 51 can be open state. This configuration enables an operator of the ink jet recording device to arbitrarily switch between the exhaust circulation and the discharge outside device.

Figure 11:
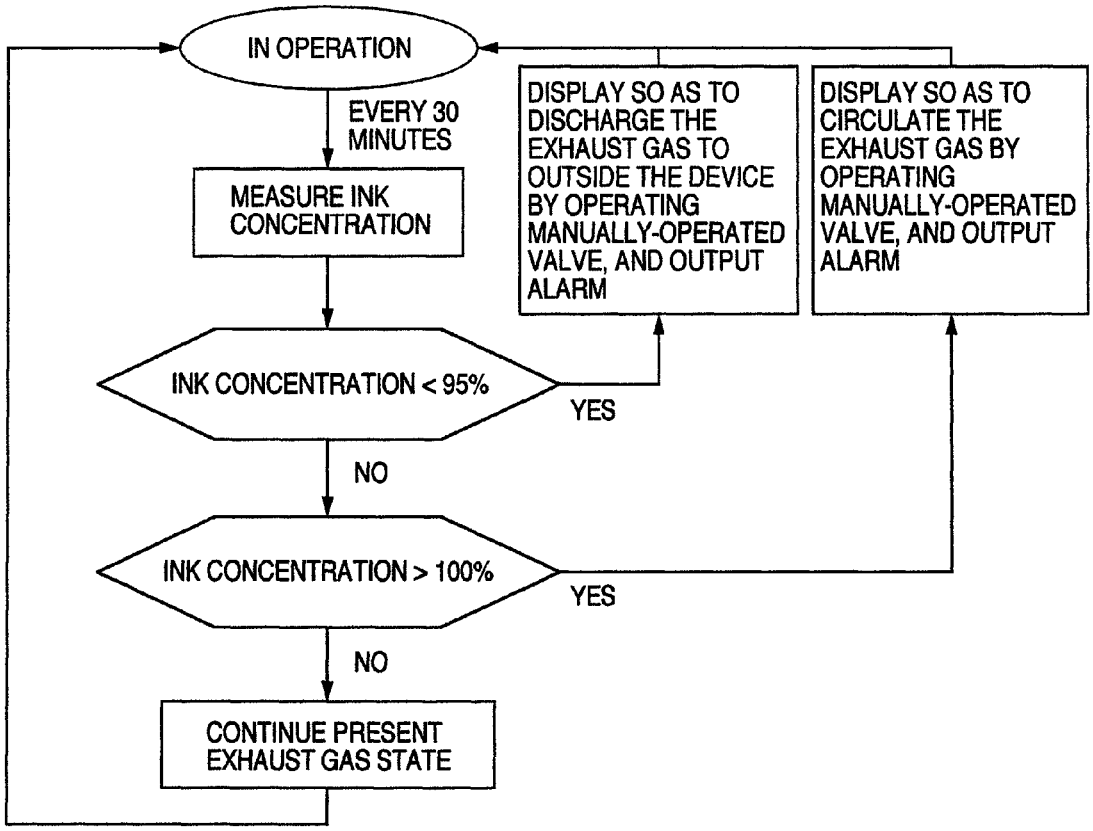
FIG. 11 is an operational flow chart of the ink jet recording device according to the third embodiment.

FIG. 11 shows the operational flow of the ink jet recording device according to the present embodiment is illustrated. During operation of the ink jet recording device, here, the measurement of the ink concentration is performed at intervals of 30 minutes. When the measurement result of the ink concentration becomes less than 95% (when standard value is set as 100%), an alarm is output from the ink jet recording device, and in a display screen, an indication to operate the manually-operated valve so as to switch the state thereof where the exhaust gas is discharged outside the device, is displayed. The display and the alarm are adapted to be deletable by the confirmation operation of the operator. Moreover, when the measurement result of the ink concentration becomes more than 100%, an alarm is also output, and in the display screen, an indication to operate the manually-operated valve so as to switch the state thereof into the exhaust circulation state where the exhaust gas is sent toward the gutter 43 of the printing head 32, is displayed. The display and the alarm are adapted to be deletable by the confirmation operation of the operator.

Fourth Embodiment

Hereinafter, a fourth embodiment will be described with reference to drawings. Note that descriptions with regard to parts which are common to those in the above mentioned embodiments are eliminated.

Figure 13:
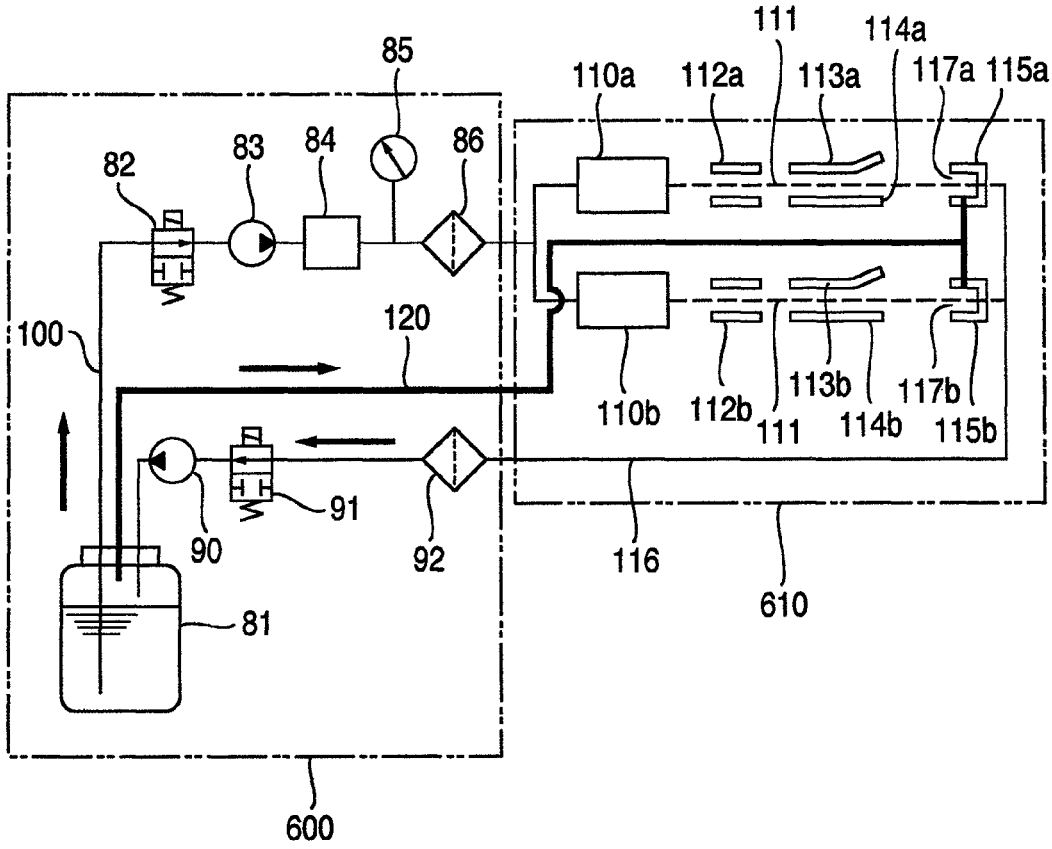
FIG. 13 is a view of the circulation path for ink and solvent vapor of the ink jet recording device according to a fourth embodiment.

First, the outline of an operation of the ink jet recording device will be described with reference to FIG. 13. In the main body 600, control components for circulation system are arranged. An ink supply flow path 100 comprises an ink container 81 to accumulate ink, an ink supply electromagnetic valve 82 to perform switching of the ink supply flow path to be open or closed, a supply pump 83 to pump the ink, a regulating valve 84 to adjust ink pressure, a pressure gauge 85 to display the pressure of the supplied ink, and a filter 86.

During performing printing, the ink is supplied from the ink container 81, through the ink supply electromagnetic valve 82, the supply pump 83, and the regulating valve 84, and, via the printing head cable 620, to the printing head 610. The ink supplied inside the printing head 610, is supplied to a first nozzle 110*a*, and jetted. An excitation source (not illustrated in the drawing) is connected to the first nozzle 110*a*, and by applying an excitation voltage to the first nozzle 110*a*, vibration is generated there depending on the frequency thereof.

The ink jetted from the first nozzle 110*a* is made as ink particles 111 continuously and regularly by the above-mentioned vibration. A recording signal source (not shown) is connected to a first electrification electrode 112*a*, and by applying a recording signal voltage on the first electrification electrode 112*a*, the ink particles 111 are individually electrified to a desired charge amount. By being applied with a voltage from a high voltage source (not shown), a first upper deflection electrode 113*a* becomes in a high voltage state, and a static electric field is formed between the first upper deflection electrode 113*a* and a first lower deflection electrode 114*a* grounded. While being deflected depending on the electrification amount thereof, the electrified ink particles 111 fly and adhere to a recording medium. In this manner, by adhering each of the ink particles 111 to a desired position, characters and letters are formed.

Among the continuously jetted ink particles 111, ink particles which do not involved in recording, are collected by the first gutter 115*a* arranged inside the printing head 610, sucked by the recovery pump 90 arranged in the main body 600, and by being passed through an ink recovery path 116 including a filter 92, and an ink recovery electromagnetic valve 91, returned to the ink container 81, and reused.

The ink supplied by the ink supply flow path 100 inside the printing head 610, before being supplied to the first nozzle 110*a*, is supplied also to a second nozzle 110*b* by a branched flow path. The ink jetted from the second nozzle 110*b*, similar to the ink jetted from the first nozzle 110*a*, is also made into ink particles 111 by excitation, which are electrified by a second electrification electrode 112*b*, deflected between a second upper deflection electrode 113*b* and a second lower deflection electrode 114*b*, and perform desired flight.

Moreover, ink particles 111 which do not involved in recording, similar to the case where the ink particles jetted from the first nozzle 110*a* are collected by the first gutter 115*a*, are collected by a second gutter 115*b*, and by being passed through the ink recovery path 116, returned to the ink container 81.

A solvent vapor supply flow path 120 is connected to the ink container 81 at a portion upper than the liquid level of the ink, and connected from the main body 600 via the printing head cable 620 to the printing head 610. The solvent vapor supply flow path 120 is branched into two flow paths near the gutters inside the printing head 610, and one of them is communicated with the first gutter 115*a* and the other of them is communicated with the second gutter 115*b*.

Gas taken in simultaneously during recovering ink collected by the gutters, is passed through the recovery path 116 into the ink container 81. At that time, a part of the solvent component of the ink is volatilized in gas into a solvent vapor. The gas containing the vapor of excess solvent in the ink container is fed to the first and second gutters 115*a* and 115*b* via the solvent vapor supply flow path 120, again taken in simultaneously at the first and second gutters 115*a* and 115*b* when they recover the ink, and returned into the ink container 81.

By repeating this, the solvent vapor is circulated inside the solvent vapor supply flow path 120 and the recovery path 116. Since, the circulated solvent vapor will be soon in a saturated state and new solvent component will not be volatilized, it is possible for the ink jet recording device to reduce the solvent amount used. At that time, if the balance between the recovery amount and the supply amount of the circulated gas is collapsed, the solvent vapor will be discharged from a first ink collection port 117*a* of the first gutter 115*a* or a second ink collection port 117*b* of the second gutter 115*b*, or inversely, new gas will be taken in. In this situation, the amount of solvent volatilization cannot be reduced.

Figure 14:
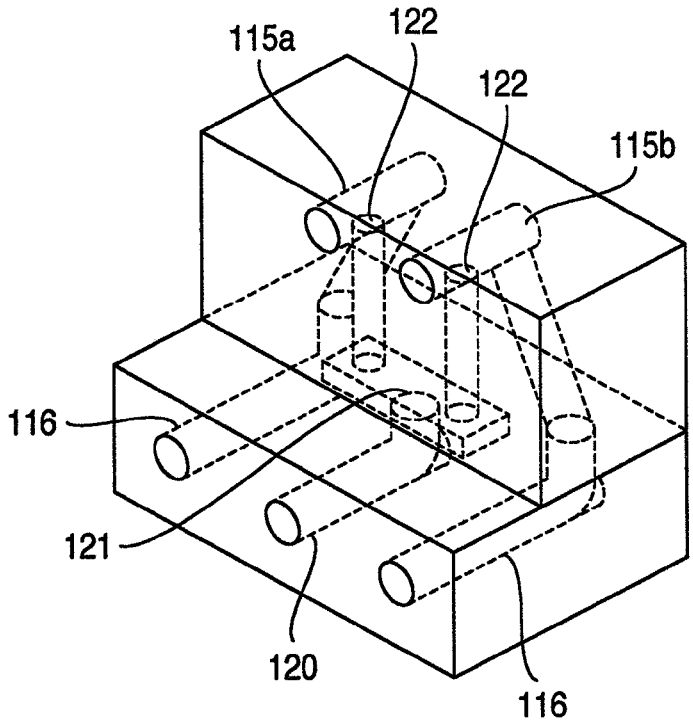
FIG. 14 is a schematic view of the gutters and the solvent supply path of the ink jet recording device according to the fourth embodiment.
Figure 15:
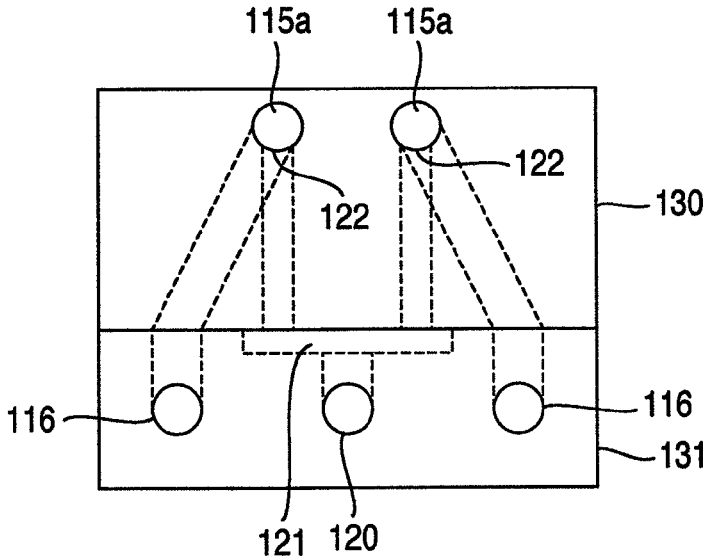
FIG. 15 is an elevation view of the schematic view of the gutters and the solvent supply path of the ink jet recording device according to the fourth embodiment.

Moreover, if gas cannot be taken in simultaneously, suction force necessary for recovering ink may not be sufficiently obtained, and the ink to be recovered may overflow from the ink collection ports 117*a* and 117*b*. Therefore, in order to ensure the balance between the two circulations, the solvent vapor supply flow path 120 is arranged at the center between the first and second gutters 115*a* and 115*b*, that is, the distance between the center and the first gutter 115*a* is equal to the distance between the center and the second gutter 115*b*, and the flow paths after the branch 121 are configured so that the length to the first gutter 115*a* and the length to the second gutter 115*b* are the same one, and the diameters thereof are the same one. FIGS. 14 and 15 show schematic views thereof. The flow paths are caused to have the same shape and the same size, so that the resistance of fluid thereof can be the same, resulting in maintenance of the balance.

Moreover, a member constituting the first gutter 115*a*, the second gutter 115*b*, the solvent vapor supply flow path 120, and a solvent vapor inlet port 122 comprises a gutter base member 130 and a gutter base member 131, and the flow path of the branch 121 of the solvent vapor supply flow path 120 is divided so that the flow path of the branch 121 is constituted between the gutter base member 130 and the gutter base member 131. The air tightness between the gutter base member 130 and the gutter base member 131 should be ensured by welding and adhesion, or intervening an elastic sealing material between them.

This enables the flow paths to be the same with high accuracy, and the gas containing solvent vapor to be delivered into the both of the gutters 115*a* and 115*b* in a balanced manner, enabling circulation to be maintained stably.

It can be considered that by providing two-systems of solvent vapor supply flow paths 120 from the ink container 81, and supplying the solvent vapor via the printing head cable 620 to the printing head 610 still by the two systems, the solvent vapor supply flow paths are connected to the gutter 115*a* and the gutter 115*b*, respectively. However, it is not suitable, because the possibility that the length, diameter, and shape etc. of the two solvent vapor supply flow paths differ from each other, increases, thereby, not only the balance of the gas circulation may be disturbed, but also it is necessary for the printing head cable 620 and the printing head 610 to have a space for the two flow paths.

What is claimed is:

1. An ink jet recording device, which performs recording by supplying ink from an ink container in which ink is accumulated, to continuously jet the ink from a nozzle, by generating ink particles continuously while vibrating the ink, and by electrifying and deflecting at least some of the ink particles to direct them to predetermined positions on a recording medium, and which comprises gutters which collect the ink particles not used for recording, a recovery flow path for recovering the ink collected by the gutters into the ink container, a solvent vapor supply flow path for supplying gas containing solvent vapor recovered in the ink container together with the ink, and two or more nozzles, wherein the solvent vapor supply flow path is communicated with two or more gutters to supply the solvent vapor from the ink container to the two or more gutters, wherein each of the two or more gutters comprise an ink flow path block having an ink inflow port, the ink flow path block through which the ink collected by the ink inflow port flows, and an exhaust flow path block connected to the inflow path block at a side of the ink recovery path from the ink inflow port.

2. The ink jet recording device according to claim 1, wherein the solvent vapor supply flow path is configured with a single path at a region from a connection portion to the ink container to the printing head including the nozzles and the gutters, and branched into two or more paths inside the printing head.

3. The ink jet recording device according to claim 1, wherein in the solvent vapor supply flow path, the branched flow paths have the same length and the same diameter in each of the two or more paths.

4. The ink jet recording device according to claim 1, wherein the gutter is divided at a branch portion of the solvent vapor supply flow path.

* * * * *